US005137619A

United States Patent [19]

Moriki et al.

[11] Patent Number: 5,137,619

[45] Date of Patent: Aug. 11, 1992

[54] METHOD OF FORMING SLIDING SURFACES

[75] Inventors: Hiroshi Moriki, Kodaira; Minoru Yonekawa, Hachioji, both of Japan

[73] Assignee: Kioritz Corporation, Tokyo, Japan

[21] Appl. No.: 708,564

[22] Filed: May 31, 1991

[30] Foreign Application Priority Data

Jun. 1, 1990 [JP] Japan ..... 2-143856

[51] Int. Cl.[5] ..... C25D 5/14

[52] U.S. Cl. ..... 205/179; 205/283; 205/222

[58] Field of Search ..... 204/41, 51, 40

[56] References Cited

U.S. PATENT DOCUMENTS 3,157,585 11/1964 Durham ..... 205/179
3,421,986 1/1969 Ruff et al. ..... 205/179
4,039,399 8/1977 Wallace et al. ..... 205/286

*Primary Examiner*—John Niebling
*Assistant Examiner*—Kishor Mayekar
*Attorney, Agent, or Firm*—Browdy and Neimark

[57] ABSTRACT

A method of forming sliding surfaces, wherein a first plating layer with a relatively high level of hardness is formed by using a first plating liquid which is at a relatively low temperature; and a second plating layer with a hardness lower than that of the first plating layer is formed on the surface of the first plating layer by using a second plating liquid which is at a temperature higher than that of the first plating liquid; the second plating layer being honed to a predetermined thickness.

7 Claims, 2 Drawing Sheets

METHOD OF FORMING SLIDING SURFACES

BACKGROUND OF THE INVENTION

This invention relates to a method of forming sliding surfaces which can be suitably applied to a cylinder in an internal combustion engine, etc.

An example of a machine member having a sliding surface is the cylinder of a small air-cooled internal combustion engine. Conventionally, the sliding surface of this cylinder has been prepared by forming a hard chrome plating layer on the inner su face of the cylinder base made of an aluminum light alloy or the like, and then honing this hard chrome plating layer so that the cylinder may have a bore of predetermined dimensional tolerances. With this method, the hard chrome plating layer is generally endowed with a high hardness of Hv 800 or more, so that, in the subsequent step of honing, a very expensive honing stick, such as a diamond wheel or a borazon wheel, has to be used. Furthermore, the service life of such a honing stick is short, resulting in high production cost. Moreover, the hard chrome plating layer is rather poor in machinability, so that it is very difficult for the finish-cut dimensions and the surface roughness of the cylinder bore to be kept within the predetermined tolerances. In addition, there is a problem that, at the initial stage of use of the cylinder, the bore of the cylinder exhibits poor fitting to the sliding surface of the associated piston.

SUMMARY OF THE INVENTION

It is accordingly the object of this invention to provide a method of forming sliding surfaces in which the above-mentioned problems in the prior art have been eliminated and which helps to form sliding surfaces with ease.

In accordance with this invention, there is provided a method of forming sliding surfaces, comprising the steps of: forming on the surface of a member a first plating layer with a relatively high level of hardness by using a first plating liquid which is at a relatively low temperature; forming on the surface of the first plating layer a second plating layer with a hardness lower than that of the first plating layer by using a second plating liquid which is at a temperature higher than that of the first plating liquid; and honing the second plating layer to a predetermined thickness.

Thus, in correspondence with the difference in temperature between the plating liquids used, the first plating layer is formed as a hard plating layer having a desired level of hardness, and the second plating layer is formed as a soft plating layer whose hardness is lower than that of the first plating layer, the second plating layer being honed to a predetermined thickness. Since the honing is performed on the soft plating layer with a desired level of hardness which is easily obtained by thus utilizing the difference between the temperatures of the plating liquids, an improvement can be achieved in terms of honability, dimensional tolerances, and surface roughness. Further, the honing stick can enjoy a long service life, and the initial fitness of the soft plating layer can be maintained at a satisfactory level at the initial stage of its use as a sliding surface.

DESCRIPTION OF THE PREFERRED EMBODIMENT

Figure 1:
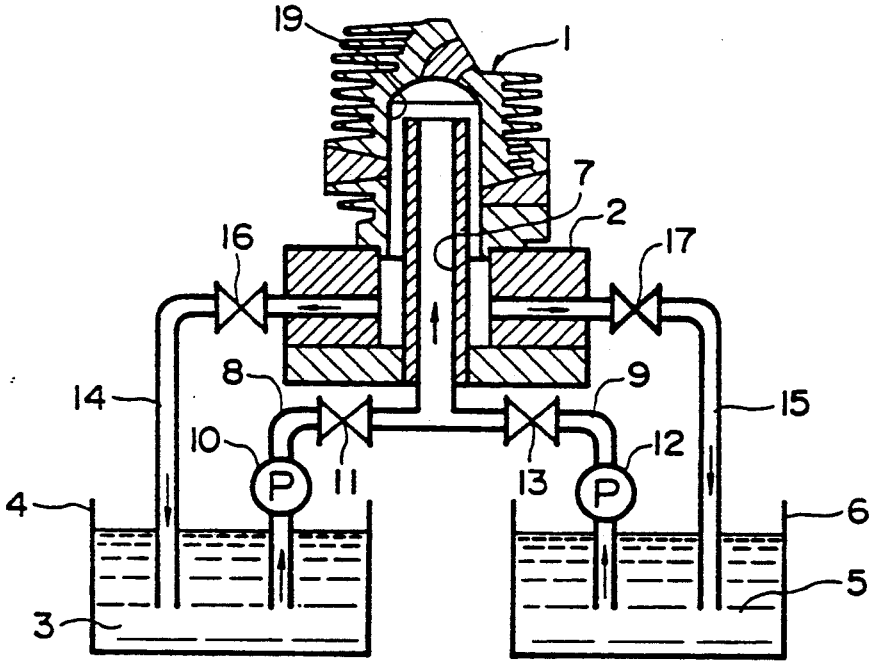
FIG. 1 is a schematic view of an embodiment of a plating device for practising the method of this invention.

FIG. 1 schematically shows an embodiment of a plating device for practising the method of this invention on the inner surface of the cylinder of a small air-cooled internal combustion engine. This plating device includes a body section 2, on which a cylinder 1 whose inner surface 1' is to be plated is mounted. The construction of this body section 2 may, for example, be substantially the same as that of the body section of the plating device disclosed in Japanese Patent Examined Publication No. 62-54398. The plating device of this invention, however, has a first plating bath 4 containing a first plating liquid 3, and a second plating bath 6 containing a second plating liquid 5. Both the first and second plating liquids 3 and 5 contain chromic acid and sulfuric acid, with their respective densities and sulfuric acid ratios being substantially the same. However, the first plating liquid 3 in the first plating bath 4 is maintained at a relatively low temperature, e.g., approximately 45°C., whereas the second plating liquid 5 in the second plating bath 6 is maintained at a relatively high temperature, e.g., approximately 55° C. or more. The body section 2 is further equipped with a plating liquid feeding duct 7 for supplying plating liquids into the bore of the cylinder 1. This plating liquid feeding duct 7 branches into a first inlet duct 8 and a second inlet duct 9. The first inlet duct 8 extends into the first plating liquid 3 in the first plating bath 4 and includes a first liquid-lift pump 10 and a first liquid-feed switching valve 11. The second inlet duct 9 extends into the second plating liquid 5 in the second plating bath 6 and includes a second liquid-lift pump 12 and a second liquid-feed switching valve 13. The body section 2 is further provided with a first return duct 14 through which the bore of the cylinder 1 communicates with the first plating bath 4, and a second return duct 15 through which the bore of the cylinder 1 communicates with the second plating bath 6. The first return duct 14 includes a first return switching valve 16. Likewise, the second return duct 15 includes a second return switching valve 17.

When chrome-plating the bore of the cylinder 1, the first liquid-feed switching valve 11 and the first return switching valve 16, which are on the side of the first plating liquid 3, are first opened, and the second liquid-feed switching valve 13 and the second return switching valve 17, which are on the side of the second plating liquid 5, are closed, with the first liquid-lift pump 10 for the first plating liquid 3 being operated. As a result, the first plating liquid 3 in the first plating bath 4 is supplied through the first inlet duct 8 and the plating liquid feeding duct 7 into the bore of the cylinder 1, and is returned through the first return duct 14 to the first plating bath 4. In this process, the first plating liquid 3 forms, under the action of an electric current having a predetermined current density, a first chrome plating layer 20 by electroplating to a predetermined thickness on the surface 19 of the base 18 of the cylinder 1, which is made of an aluminum light alloy or the like.

Subsequently, the first liquid-lift pump 10 for the first plating liquid 3 is stopped, and the first valves 11 and 16 on the side of the first plating liquid 3 are closed, with the second liquid-feed switching valve 13 and the second return switching valve 17 on the side of the second plating liquid 5 being opened and the second liquid-lift pump 12 on the side of the second plating liquid 5 being operated. As a result, second plating liquid 5 in the second plating bath 6 is supplied through the second inlet duct 9 and the plating liquid feeding duct 7 into the bore of the cylinder 1, and is returned through the second return duct 15 to the second plating bath 6. In this process, the second plating liquid 5 forms, under the action of an electric current having the current density as that for the first plating liquid 3, a second chrome plating layer 22 to a predetermined thickness by electroplating on the surface 21 of the first chrome plating layer 20.

Figure 2:
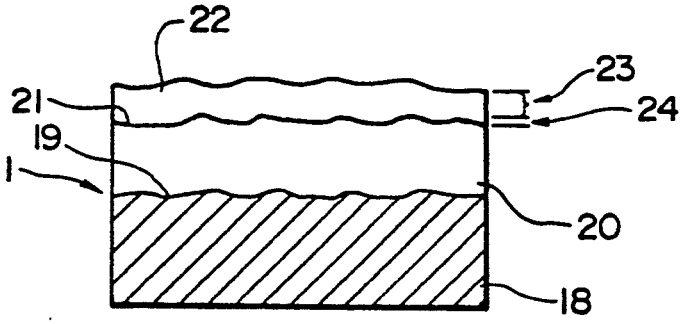
FIG. 2 is a sectional view of the essential part of a member on which plating layers are framed by the method of this invention.
Figure 3:
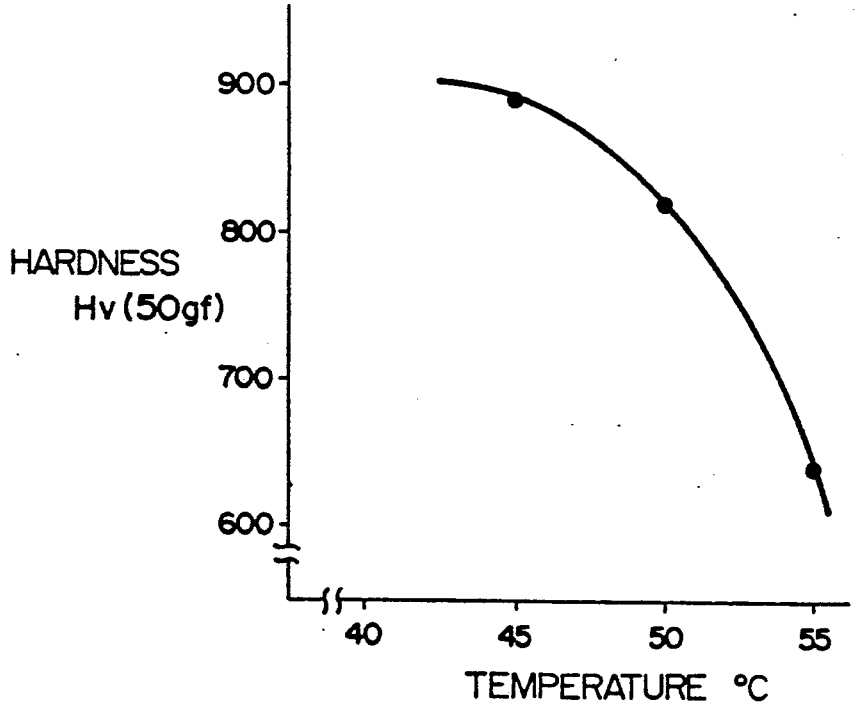
FIG. 3 is a chart showing the relationship between plating liquid temperature and plating layer hardness in the method of this invention.

FIG. 2 shows, in section, a surface portion of the bore of the cylinder 1 prepared in this way. In this embodiment, the thickness of the first chrome plating layer 20 ranges approximately from 35 to 50 microns, and that of the second chrome plating layer 22 ranges approximately from 15 to 20 microns. As stated above, the first and second plating liquids 3 and 5 have the same chromic acid density and the same sulfuric acid ratio and are electroplated under the action of electric currents having the same current density, so that the respective hardnesses of the first and second chrome plating layers 20 and 22 depend upon the respective temperatures of the first and second plating liquids 3 and 5. The relationship between plating liquid temperature °C. and plating layer hardness Hv is shown in the chart of FIG. 3. In the case of this example, the chrome acid density of the plating liquids 3 and 5 is 500 g/l, and the sulfuric acid ratios thereof is 150:1. The current density is 1,250 $A/dm^2$ and the plating is performed by the liquid flow method described above. Under these conditions, the respective temperatures of the first and second plating liquids 3 and 5 are appropriately controlled, whereby, in this embodiment, the first chrome plating layer 20 is formed as a hard chrome layer having a hardness of not lower than Hv 850, which corresponds to the hardness level usually required of a cylinder, and the second chrome plating layer 22 is formed as a relatively soft chrome layer having a hardness of Hv 650 or less.

The second chrome plating layer 22, which is thus formed as a relatively soft layer, is then honed, with the honing allowance 23 being removed. The honing is performed to a predetermined dimension so as to leave a soft chrome plating layer 24 having an average thickness of approximately 5 microns. Thus, the cylinder 1 is equipped with a hard chrome layer, i.e., the first chrome plating layer 20, formed on the surface 19 of the base 18 thereof, and a soft chrome layer 24 formed on the surface 21 of the hard chrome layer 20. At the initial stage of use of the cylinder 1, the soft chrome layer 24 serves as an initial-drive wear layer having a satisfactory level of fitness, and, during the normal operation after that, the hard chrome layer 20 under it 24 serves as a wear resisting layer. Further, since the honing is performed on the second chrome plating layer 22 having a relatively low level of hardness, the file for the honing may be a relatively inexpensive one, and the service life of the file can be relatively long. In addition, the dimensions and the surface roughness of the inner surface of the cylinder can be easily kept within predetermined tolerances. If the surface 21 of the first chrome plating layer 20 is defective in terms of flatness (as shown in an exaggerated form in FIG. 2), part of the first chrome plating layer 20 may become exposed as a result of the above honing. Such exposure, however, is of an almost negligible order, and there is substantially no risk that the fitness of the cylinder at its initial stage of use will be impaired.

It goes without saying that, while in the above embodiment the method of this invention is applied to the sliding surface of a cylinder made of an aluminum alloy, this should not be construed as restrictive.

What is claimed is:

1. A method of forming sliding surfaces, consisting essentially of the steps of: forming on the surface of a member a first plating layer with a relatively high level of hardness by using a first plating liquid which is at a relatively low temperature; forming on the surface of said first plating layer a second plating layer with a hardness lower than that of said first plating layer by using a second plating liquid which is at a temperature higher than that of said first plating liquid; and then honing said second plating layer to a predetermined thickness.

2. A method of forming sliding surfaces, comprising the steps of:

forming on the surface of a member a first plating layer with a relatively high level of hardness by using a first plating liquid which is at a relatively low temperature;

forming on the surface of said first plating layer a second plating layer with a hardness lower than that of said first plating layer by using a second plating liquid substantially the same as said first plating liquid and which is at a temperature higher than that of said first plating liquid; and then honing said second plating layer to a predetermined thickness.

3. A method according to claim 2 wherein said first and second plating liquids both contain chromic acid and sulfuric acid with respective densities and sulfuric acid ratios being substantially the same.

4. A method according to claim 2 wherein said first plating liquid is maintained at a temperature of approximately 45° C. and said second plating bath is maintained at a temperature of approximately 55° C.

5. A method according to claim 2 wherein said forming of said first plating layer and said forming of said second plating layer are effected using approximately the same current density.

6. A method according to claim 2 wherein said forming of said first plating layer is carried out at a temperature producing a hard chrome layer having a hardness of not lower than Hv 850, and said forming of said second plating layer is carried out at a temperature producing a second plating layer having a hardness of not greater than Hv 650.

7. A method of forming sliding surfaces, comprising the steps of:

forming on the surface of a member a first plating layer with a relatively high level of hardness by using a first plating liquid which is at a relatively low temperature;

forming on the surface of said first plating layer a second plating layer with a hardness lower than that of said first plating layer by using a second plating liquid at approximately the same current density and which is at a temperature higher than that of said first plating liquid; and then honing said second plating layer to a predetermined thickness.

* * * * *